US006425219B1

(12) United States Patent
Barmak et al.

(10) Patent No.: US 6,425,219 B1
(45) Date of Patent: Jul. 30, 2002

(54) MODULAR PARTITION SYSTEM

(76) Inventors: Jack Barmak, 113 Joanna Crescent, Thornhill, Ontario (CA), L4J 5G1; David Shamir, 30 Campbell Ave., Thornhill, Ontario (CA), L4J 2J4

( * ) Notice: Subject to any disclaimer, the term of this patent is extended or adjusted under 35 U.S.C. 154(b) by 0 days.

(21) Appl. No.: 09/586,894

(22) Filed: Jun. 5, 2000

(30) Foreign Application Priority Data

Feb. 24, 2000 (CA) ..... 2299488

(51) Int. Cl.[7] ..... E04H 1/00

(52) U.S. Cl. ..... 52/239; 52/238.1; 52/240; 52/241; 52/243; 52/653.1; 52/656.1

(58) Field of Search ..... 52/239, 238.1, 52/240, 241, 243, 653.1, 656.1, 656.2, 220.1, 220.2, 220.6, 220.7, 220.8, 483.1, 479

(56) References Cited

U.S. PATENT DOCUMENTS 5,406,760 A 4/1995 Edwards
5,852,904 A 12/1998 Yu et al.
5,974,753 A * 11/1999 Hsu ..... 52/506.01
6,226,947 B1 * 5/2001 Bado et al. ..... 52/483.1

* cited by examiner

*Primary Examiner*—Beth A. Stephan
*Assistant Examiner*—Dennis L Dorsey

(57) ABSTRACT

A modular partition system is based upon a panel frame structure formed of vertical members of substantially lesser thickness than the panels to be formed, which may be joined end-to-end in a modular manner, and side-by-side to join vertical ends of adjacent panels, and horizontal C-section rails secured to opposite sides of the vertical rails with mouths of the C-sections facing outwardly. Cladding panels are secured by vertically-spaced sets of spring clips engaging respectively upper and lower surfaces of vertically-spaced horizontal rails, and panels and other furnishings are secured to brackets engaged within the C-section of horizontal rails. The relationship of the horizontal and vertical members allows for easy cabling, and the use of the clamps permits panels and furnishings to be located without substantial regard to the horizontal modularity of the system. The basic panelling system requires a minimum number of different modular parts.

14 Claims, 6 Drawing Sheets

MODULAR PARTITION SYSTEM

FIELD OF THE INVENTION

This invention relates to modular partition systems such as are used to partition office or other workspace, and to support work surfaces and storage and other modules.

BACKGROUND OF THE INVENTION

Such systems are typically formed of vertical panels which are interconnected at their edges to form desired partitions. Such systems impose both horizontal and vertical modularity on the resulting structure. The horizontal modularity entails that the dimensions of the walls of the structure can be varied only in increments imposed by available panel sizes. There is also a problem is accommodating cabling which must be threaded through the ends of the panels and is difficult to alter after the system is installed. Some such systems make use of panel frames with clip-on cladding, as exemplified by U.S. Pat. No. 5,406,760 (Edwards) in which the panels comprise horizontal frame members disposed outwardly of vertical frame members such that, when panels are secured together in the same plane, the horizontal members are aligned to form continuous rails on which furnishings may be located horizontally without regard to the modularity of the panels. Cabling may be passed horizontally between the outside panels and the vertical members, and vertically between the horizontal members, facilitating cabling.

U.S. Pat. No. 5,582,904 also uses panels having narrow vertical members and spaced horizontal box beams of greater width supporting external cladding and providing channels which locate clips supporting furnishings or panels at any desired horizontal location. The box beams are provided with vertical pass-through to permit vertical cabling, horizontal cabling being accommodated between the box beams. The latter nevertheless are complex fabrications, and complicate assembly of the panels.

SUMMARY OF THE INVENTION

In is an object of the present invention to provide a partitioning system which provides for flexible location of furnishings, and junctions between partition walls, yet can be assembled from simple modular components.

The invention relies on a panel frame structure comprised of vertical members of substantially lesser thickness than the panels to be formed, which may be joined end-to-end in a modular manner, and side-by-side to join vertical ends of adjacent panels, and horizontal C-section rails secured to opposite sides of the vertical rails with mouths of the C-sections facing outwardly. Cladding panels are secured by vertically-spaced sets of spring clips engaging respectively upper and lower surfaces of vertically-spaced horizontal rails, and panels and other furnishings are secured to brackets engaged within the C-section of horizontal rails. The relationship of the horizontal and vertical members allows for easy cabling, and the use of the clamps permits panels and furnishings to be located without substantial regard to the horizontal modularity of the system. The basic panelling system requires a minimum number of different modular parts.

Accordingly, the invention provides a partitioning system having a panel frame structure, each panel frame having vertical end members arranged in a common plane and adapted to be joined end-to-end with those of other panels, and horizontal frame members arranged in vertically-spaced pairs and secured to opposite side faces of the vertical members, the horizontal members each being of C-section with openings of the C-sections facing outwardly. Preferably the system further includes cladding panels and clips securing the panels to the frame structure externally of the horizontal members, or the clips being secured to the panels and engaging a top surface of one horizontal member, and a bottom surface of another horizontal member vertically spaced from said one horizontal member on the same side of the frame structure.

Preferably, the system also includes at least one clamp member entering a horizontal member through the opening of its C-section and releasably clamped therein, and at least one of a furnishing support, a work surface and a further panel attached to the clamp member.

The invention is described further below with reference to a presently-preferred embodiment as illustrated by the accompanying drawings:

SHORT DESCRIPTION OF THE DRAWINGS

DESCRIPTION OF THE PREFERRED EMBODIMENT

Figure 1:
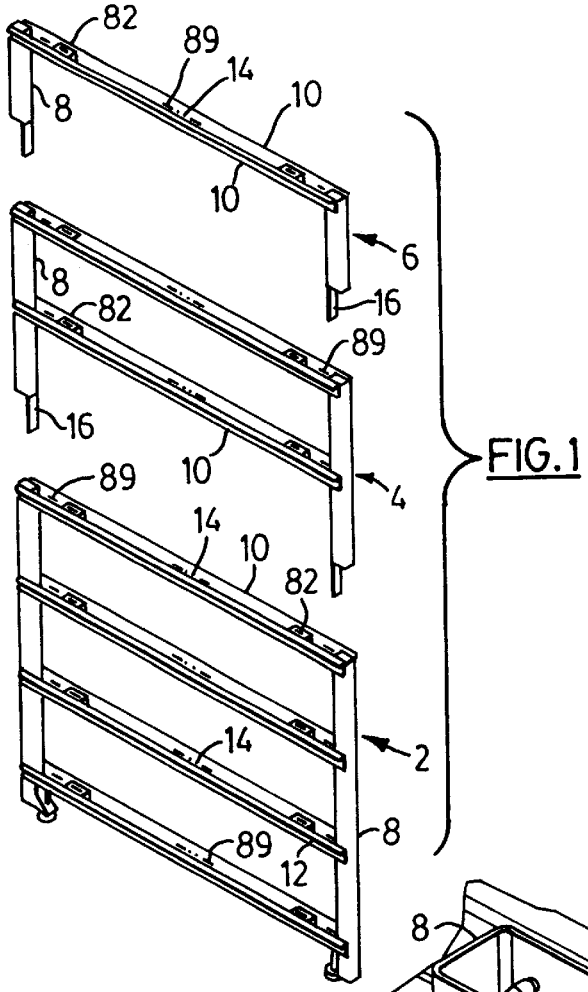
FIG. 1 is an isometric view showing basic frame modules forming the basis of a preferred embodiment of the invention.

Referring to FIG. 1, at least the spines of partitions in a system according to the invention are made up of panel frame modules; in the example shown, a 105 cm high base module 2 which may be built up to any desired panel height by the addition of 60 cm and or 30 cm modules 4 and 6. The individual modules are made up of vertical end members 8 of hollow rectangular section, and C-section horizontal members 10 secured by fasteners or otherwise to the vertical members with the opening 12 of each C-section facing outwards. Additional intermediate vertical members (not shown) can be added, if required, either during installation or at any time thereafter, being secured to the horizontal members by fasteners passing through the holes 14.

Figure 3:
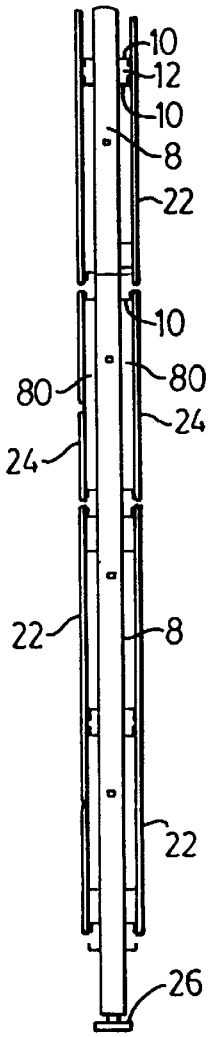
FIG. 3 is an end view of a partition formed of assembled frame modules with panels attached.
Figure 2:
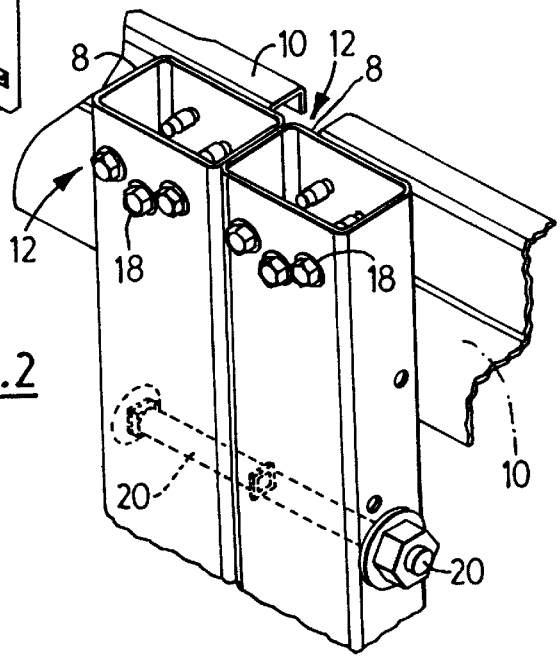
FIG. 2 is a fragmentary isometric view illustrating how adjacent coplanar frames are connected.
Figure 11:
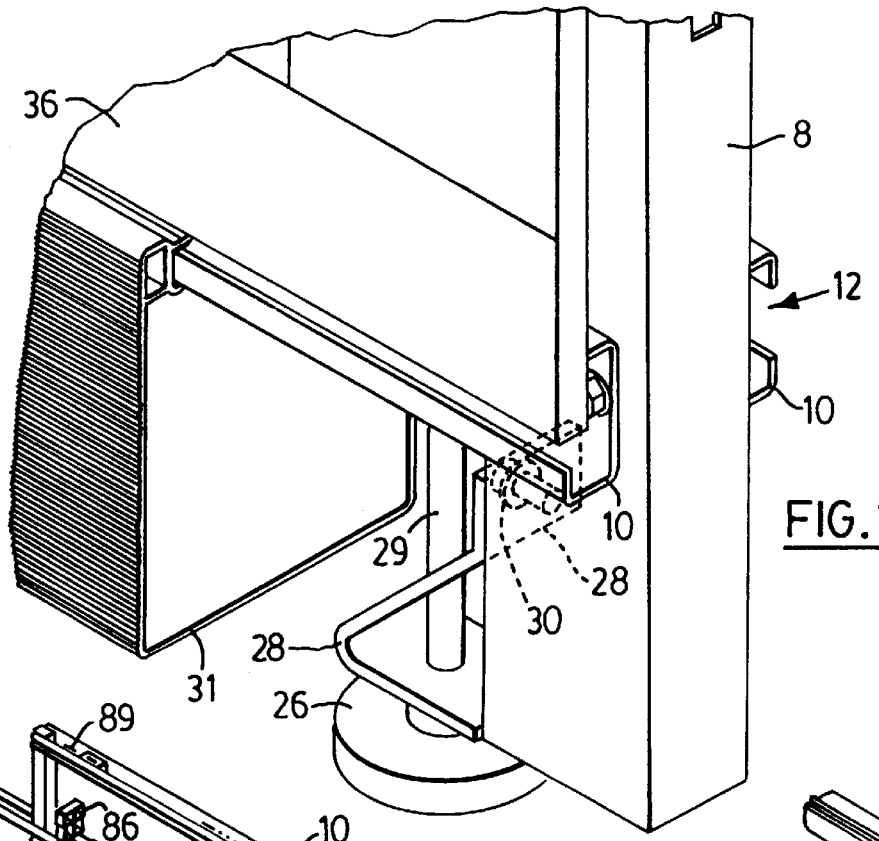
FIG. 11 is an isometric view of a leveler foot at the base of a column of a panel frame.
Figure 13:
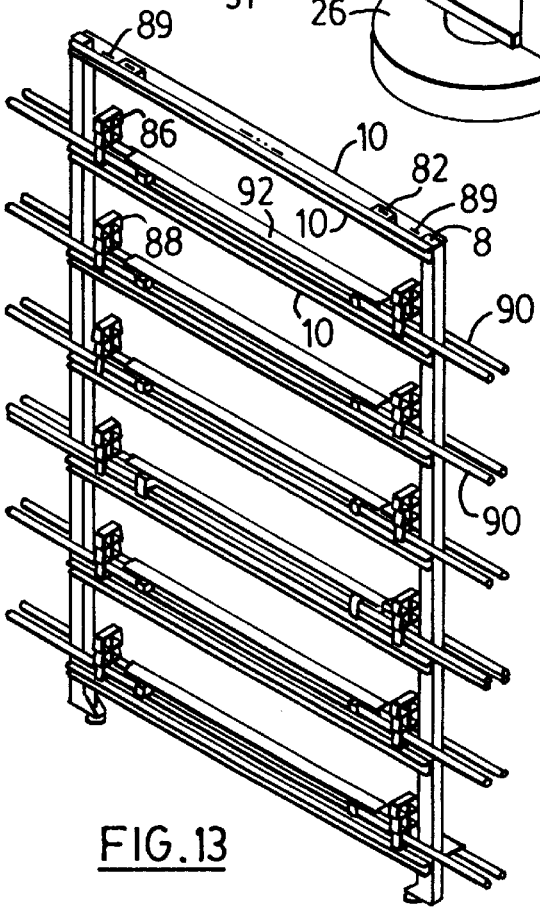
FIG. 13 is an isometric view of a partition unit incorporating cable organizers so as to provide a raceway at any height on either face of a panel frame.

The vertical members 8 of the modules may be connected by tongues 16 fitting within and secured by fasteners to the rectangular sections. Adjacent panel frames may be connected as shown in FIG. 2 by bolts 20. This figure also shows the fasteners, in this example screws 18, securing the horizontal members. The panels are completed as shown in FIG. 3 by clipping cladding tiles 22 or other cladding elements such as raceway covers 24 to the upper and lower external surfaces of the horizontal members 10 as seen in FIG. 3. The cladding tiles may be installed and removed independently without interference with adjacent tiles. Tiles may be interchanged to renovate the system or to suit decorative schemes. Each vertical member 8 is provided at its lower end with a levelling foot 26 (see FIG. 11) having a threaded shaft 20 which screws into a bracket 28 secured by a screw 30 in engagement with the member 8. The offset position of the levelling foot and its shaft 20 relative to the member 8 facilitates levelling of panels whether manually or using a power tool. A scuff protector 31 may be clipped to the lowest members 10 to close the gap between the panels 22 and the floor.

Figure 4:
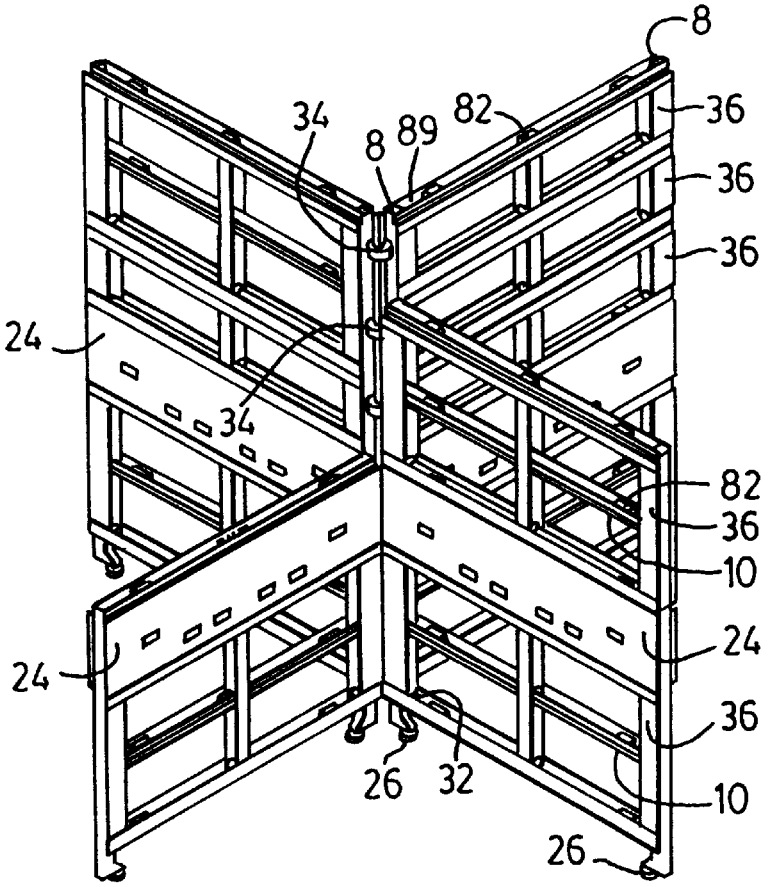
FIG. 4 is an isometric view illustrating the connection of four partitions of different heights at their vertical edges.

At the intersection of three or four panels, the panels may be secured, instead of by bolts 20, by shorter bolts 32, engaging turned-up flanges of cups 34, as best seen in FIG. 4, which also shows the frames 36 of cladding tiles 22, as well as raceway covers 24. As shown, panels of different heights may be connected in this manner.

Figure 5:
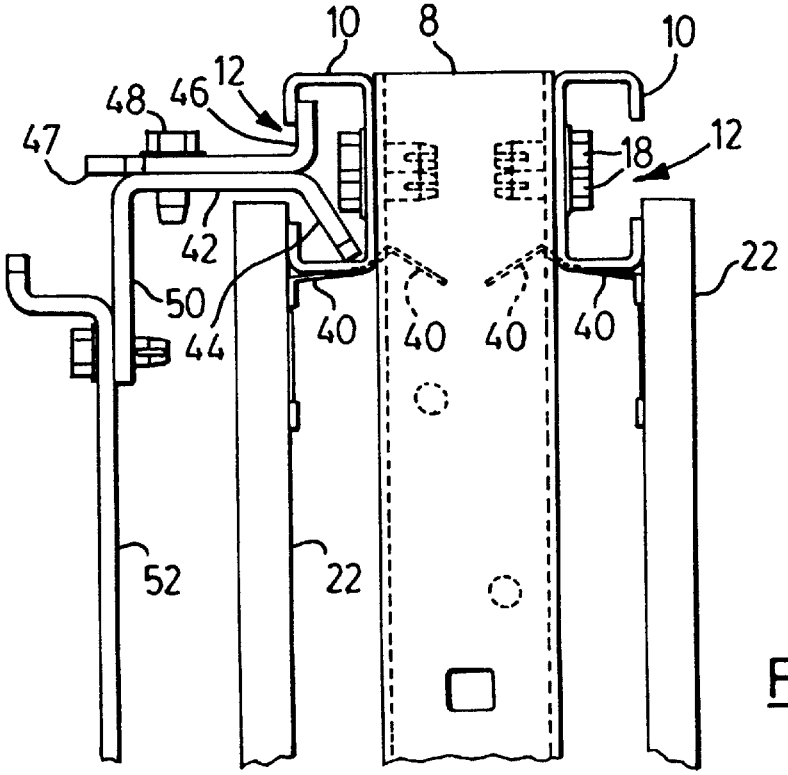
FIG. 5 is a fragmentary end view of a panel frame illustrating the attachment of cladding panels and of brackets supporting furnishings or other panel frames.
Figure 6:
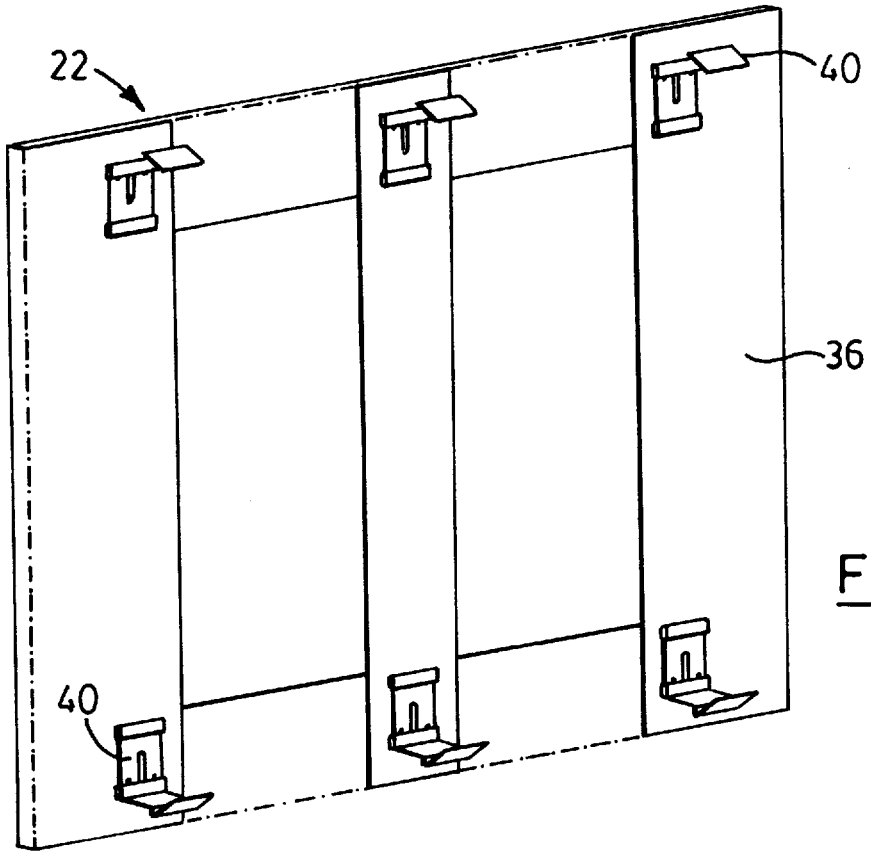
FIG. 6 is an isometric view of a cladding panel prior to attachment.

As best seen in FIG. 5, the C-shaped horizontal members support the cladding tiles 22 and raceway covers, by means of spring clips 40. As seen in FIG. 6, oppositely-acting rows of these clips are secured to the frame 36 of the tile.

Figure 7:
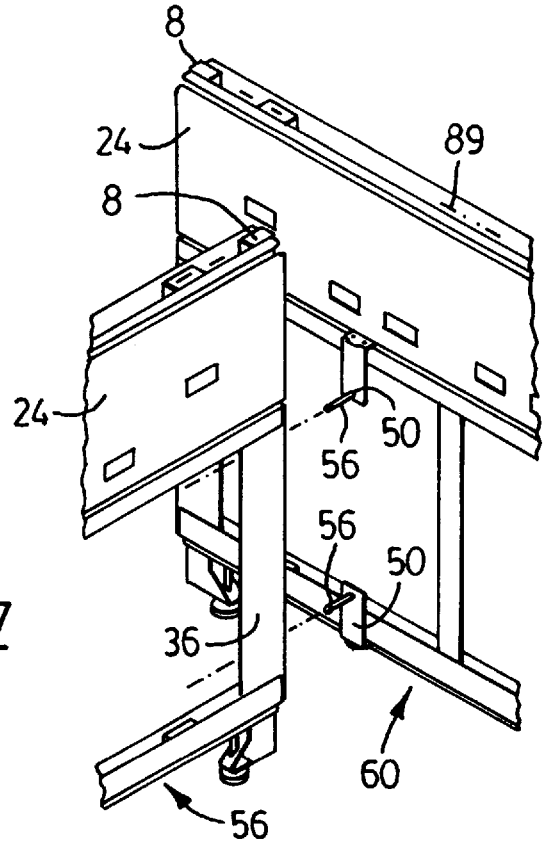
FIGS. 7 through 10 are fragmentary isometric views of brackets for supporting panels, furnishing units and work surfaces at points intermediate the length of panel frames.
Figure 8:
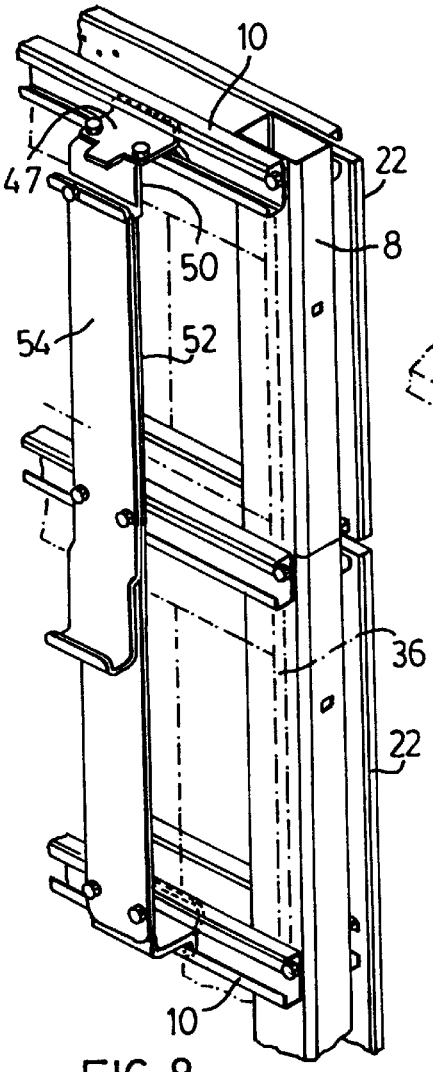

Heavier duty connections to the panel frames intermediate the module lengths are made through brackets as shown in FIGS. 5 and 7 to 9. A portion 42 of each bracket forms a cantilever with an inclined distal portion 44 which is easily inserted within the C-section of a horizontal member so as to engage its bottom wall. It can then be clamped in place by a clamp member 46 which engages the top and upper outer walls of the C-section and is secured in place by fasteners, in this case, a screw or screws 48. The outer end 50 of the cantilever formed by the portion 42 may take various forms, according to application. In FIGS. 5 and 8, it is turned downwardly (or upwardly if the bracket is mounted upside down as seen at the bottom of Figure) to support a bracket 52 or brackets 52 and 54, used to support heavy furnishings such as cabinets. The clamp member 46 may include a projecting tab 47 designed to lock into a corresponding slot in the back of a cabinet (not shown) to lock the latter in place on the bracket.

In FIG. 7, each portion 50 may support a bolt 56, enabling a panel 58 to be secured perpendicular to the first panel at any point along the length of a panel 60.

Figure 9:
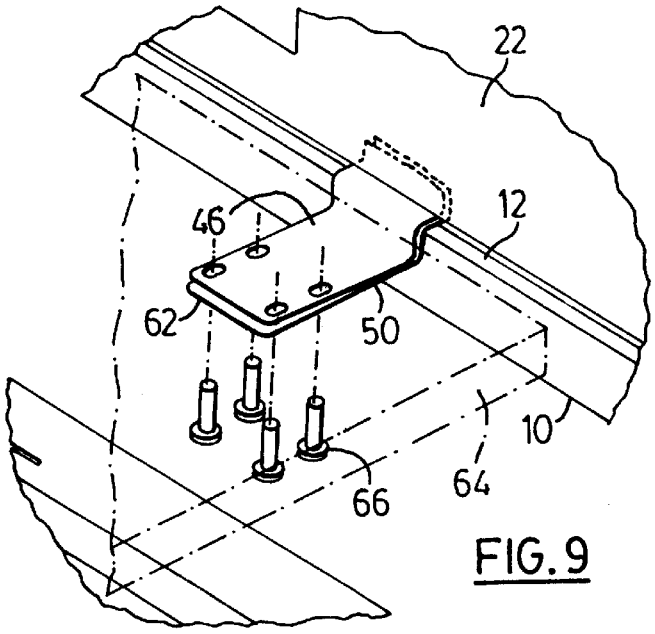

In FIG. 9, the end 50 is turned outward horizontally and forms a mounting plate 62 which supports a work surface 64 to which it is secured by screws 66.

Figure 10:
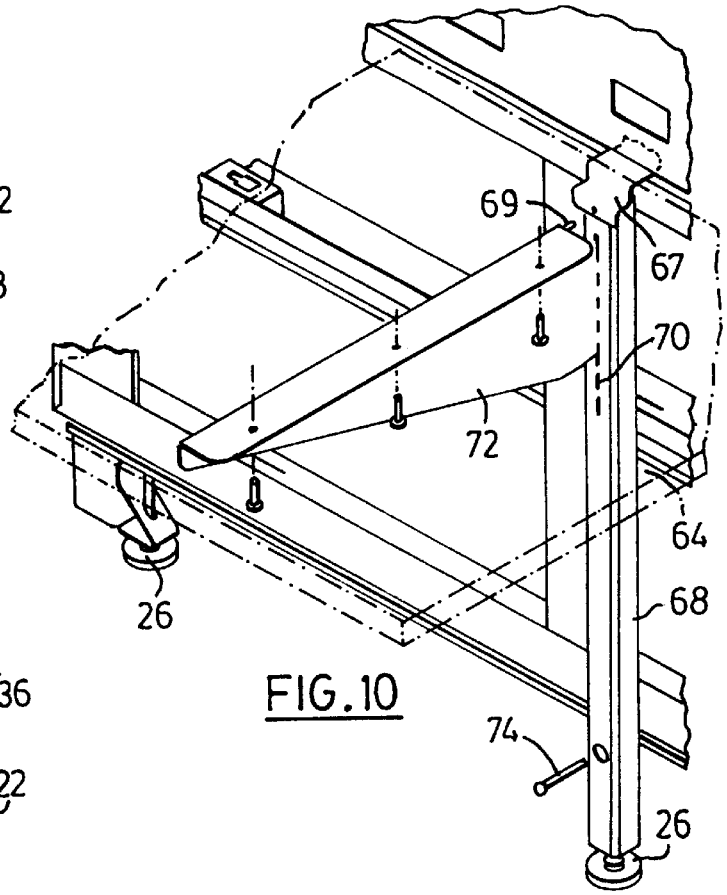

In FIG. 10, an inner end of a bracket 67 is upturned (not shown) to engage within an upper portion of a C-section, while its outer end is cranked outwardly and secured by a screw 69 or other fastener to the top of an auxiliary column 68 which is provided with a vertical row of vertical slots 70 to accept cantilever brackets such as the bracket 72. The reaction from a work surface 64 supported by such a bracket is sustained by a leveler foot at a lower end of the column 68 which bears all the vertical load applied through the bracket, while screw 74 bearing on a lower horizontal member sustains torsional loads, which screw may be turned to adjust the angle of the work surface.

It will be appreciated that the brackets described above with reference to FIGS. 5–10 permit installation of branch panels, work surfaces, cabinets and shelving at any point along a spine formed by the panels, without regard to the horizontal modularity of the latter.

Figure 12:
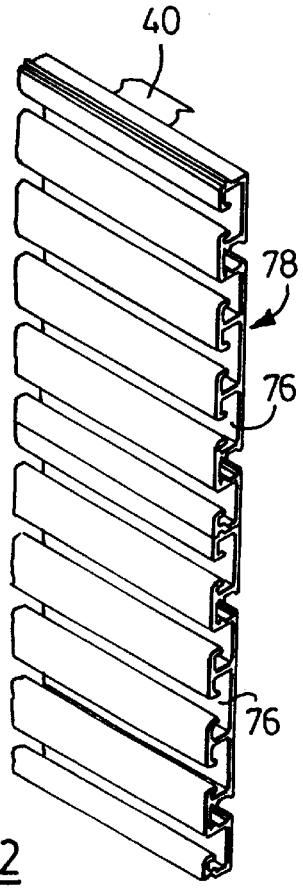
FIG. 12 is a fragmentary isometric view of an alternative form of cladding panel.
Figure 14:
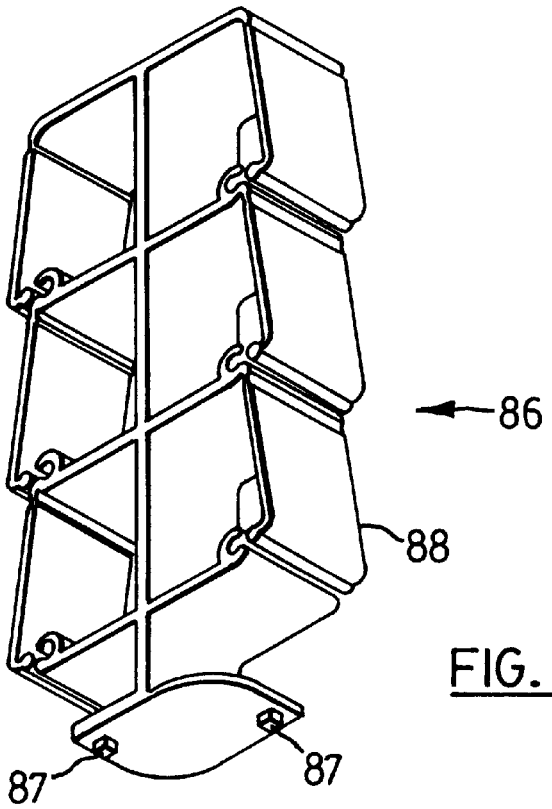
FIG. 14 is an isometric view of a cable organizer.

FIG. 12 shows a form of panel 78 which may be used in place of a panel 22, and presents a series of horizontal C and G-section channels 76 which may support various types of brackets supporting furnishings which can then be moved horizontally without regard to the modularity of the panel frame.

It is a feature of the panel system of the present invention that the horizontal C-section members 10 provide stand offs for the cladding tiles 22 and other cladding elements from the vertical columns 8, allowing ample space between the tiles and the columns for raceways 80 (see FIGS. 3 and 12). Brackets 82 secured between members 10 on opposite sides of the vertical members provide support for modules of modular electric bus equipment 92, such as outlets and connectors which may be installed at any desired height, while cable organizers 86 have base members having tabs 87 which lock into slots 89 in the members 10 (see FIG. 1), and hinged side flaps 88 which allow cables 90 to be inserted into them.

Figure 15:
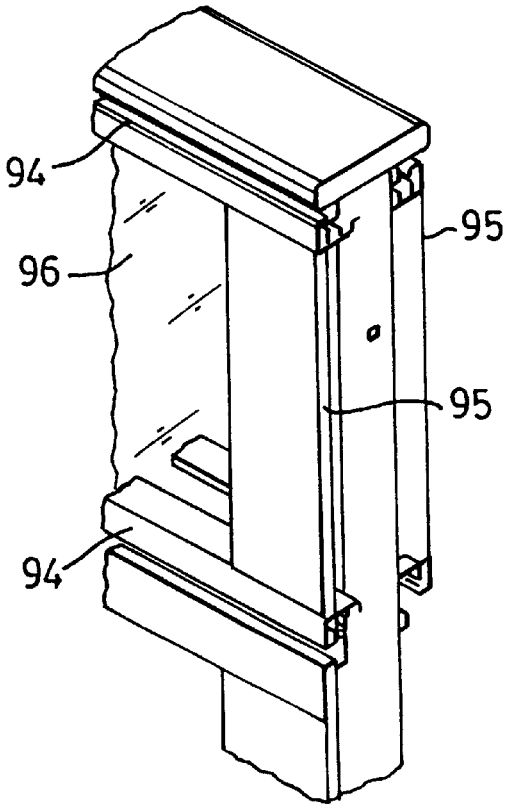
FIG. 15 is an isometric view illustrating the mounting of window panels.

It will be seen that the basic partition structure described so far can be made up from a relatively small inventory of parts. While the panel frame modules 2, 4 and 6 may be pre-assembled, they are formed from lengths of rectangular section tube, lengths of C-section, plates forming the tongues 16, and the brackets 82. While the parts may be bolted together, it may be preferable in pre-assembled modules to weld the parts together. The cladding tiles comprise simple frames 36 to which the clips 40 are attached, with a fabric or other cladding, while the raceway covers may be pressed from sheet metal and the clips 40 attached. In suitable locations, the cladding tiles may be replaced by window units, or soundproof or other panels. As seen in FIG. 15, window units may be formed with head and sill members 94 which may be plastic extrusions and clip onto respectively lower and upper halves of the C-section members 10, and stiles 95 which may similarly be plastic extrusions and clip around vertical members 8 to provide together a frame retaining a glazing or other panel 96. This figure also shows how a panel may be fitted with a top trim 98 clipped over upper portions of C-section members 10. Heavier duty connections to branch panels or other furnishings may be made in a module independent manner using the clamps described with reference to FIGS. 5 and 7 through 10, again using a minimal number of basic parts and no tools other than wrenches and screwdrivers.

The raceways 80 provide ample space for horizontal cable runs, while plenty of space for vertical runs and modular bus units is provided between the horizontal rails 20. The cables are easily installed, and panels can be moved without cutting existing cables.

The basic panels which form the spine of the system do not depend on the attachment of legs, work surfaces or other furnishings for their rigidity, and tables, desk or other moveable furniture may be placed adjacent the panels without being attached to them.

We claim:

1. A partitioning system having a panel frame structure, each panel frame having vertical end members arranged in a common plane and adapted to be joined end-to-end with those of other panels, and horizontal frame members arranged in vertically spaced pairs and secured to opposite side faces of the vertical members, the horizontal members each being of C-section with openings of the C-sections facing outwardly.

2. A partitioning system according to claim 1, further including cladding panels and clips, securing the panels to the frame structure externally of the horizontal members, the clips being secured to the panels and engaging a top surface of one horizontal member, and a bottom surface of another horizontal member vertically spaced from said one horizontal member on the same side of the frame structure.

3. A partitioning system according to claim 1, further including at least one clamp member entering a horizontal member through the opening of its C-section and releasably clamped therein, and at least one of a furnishing support, a work surface and a further panel attached to the clamp member.

4. A partitioning system according to claim 2, further including at least one clamp member entering a horizontal member through the opening of its C-section and releasably clamped therein, and at least one of a furnishing support, a work surface and a further panel attached to the clamp member.

5. A partitioning system according to claim 2, further including horizontal cabling in at least one raceway defined between adjacent vertically-spaced horizontal members on the same side of the vertical members.

6. A partitioning system according to claim 4, further including horizontal cabling in at least one raceway defined between adjacent vertically-spaced horizontal members on the same side of the vertical members.

7. A partitioning system according to claim 4, further including brackets secured in bottom ends of the vertical members, and feet screwed into the brackets.

8. A partitioning system according to claim 4, including at least one frame formed of vertically stacked panel frame modules having vertical frame elements which are connected end-to-end to form the frame.

9. A partitioning system according to claim 4, wherein brackets are secured between pairs of horizontal members on opposite sides of a panel frame to save bus modules.

10. A partitioning system according to claim 6, wherein cable organizers are secured between pairs of horizontal members on opposite sides of a panel frame to support cables in said at least one raceway.

11. A partitioning system according to claim 4, wherein each clamp member comprises a cantilever entering the horizontal member through the opening and extending to one end of the C-section, a clamp member entering the horizontal member through the opening and extending to the other end of the C-section, and at least one fastener securing the clamp member to the cantilever outside of the C-section.

12. A partitioning system according to claim 11, including a work surface supporting bracket secured to the cantilever outward of a cladding panel an element attached to the cantilever for supporting another panel.

13. A partitioning system according to claim 11, including an element attached to the cantilever for supporting another panel.

14. A partitioning system according to claim 11, including a vertical column connected to the cantilever external of the cladding panels, the column having a vertical row of slots to receive cantilever brackets.

* * * * *